United States Patent [19]

Herrin et al.

[11] Patent Number: 5,002,095

[45] Date of Patent: Mar. 26, 1991

[54] ELECTRONIC CONTROL OF TERRY PILE WARP YARN DISPENSING RATE

[75] Inventors: Eugene J. Herrin, Oakboro; Dennis L. Starnes, Kannapolis, both of N.C.

[73] Assignee: Fieldcrest Cannon, Inc., Eden, N.C.

[21] Appl. No.: 422,628

[22] Filed: Oct. 17, 1989

[51] Int. Cl.[5] ..... D03D 39/22

[52] U.S. Cl. ..... 139/25; 139/102; 139/105

[58] Field of Search ..... 139/25, 102, 105, 100

[56] References Cited

U.S. PATENT DOCUMENTS

| | | | |
|---|---|---|---|
| 3,746,052 | 7/1973 | Burgess et al. | 139/102 X |
| 3,871,419 | 3/1975 | Pfarrwaller . | |
| 4,122,873 | 10/1978 | Pfarrwaller et al. . | |
| 4,293,006 | 10/1981 | Peter . | |
| 4,569,373 | 2/1986 | Vogel . | |
| 4,585,037 | 4/1986 | Kimbara . | |
| 4,721,134 | 1/1988 | Dorman et al. . | |
| 4,827,985 | 5/1989 | Sugita et al. | 139/25 |
| 4,884,597 | 12/1989 | Tamura et al. | 139/25 X |

*Primary Examiner*—Andrew M. Falik

*Attorney, Agent, or Firm*—Bell, Seltzer, Park & Gibson

[57] ABSTRACT

A terry loom having a negative pile warp let-off motor is electronically controlled to produce terry having uniform pile-to-ground warp ratio. The negative pile warp let-off motor is controlled to dispense pile warp yarn at a rate which yields the desired pile-to-ground warp ratio regardless of the tension on the pile warp yarn. The desired rate of pile warp let-off may be provided to the loom controller as a known quantity or may be calculated by the loom controller based upon the known desired pile-to-ground warp ratio and a measured or preset ground warp let-off rate. The desired pile warp let-off rate is compared to the actual pile let-off rate, and a signal is generated based upon deviations between actual and desired pile warp let-off rates, to control the pile warp let-off motor. Simplified control with uniform pile-to-ground warp ratio is thereby provided.

41 Claims, 3 Drawing Sheets

ELECTRONIC CONTROL OF TERRY PILE WARP YARN DISPENSING RATE

FIELD OF THE INVENTION

This invention relates to the manufacture of terry cloth, and more particularly to a method and apparatus for electronic control of terry looms to obtain a uniform ratio of pile to ground warp and thereby produce uniform terry fabric.

BACKGROUND OF THE INVENTION

In the manufacture of terry cloth, the height of the terry pile loops is a critical parameter. For example, in a typical high pile terry, approximately 55% of the total fabric is pile yarn. Any fluctuation in the pile height has an adverse effect on the fabric's weight, which may be unacceptable to customers and may require the fabric to be sold as seconds. Accordingly, uniform control of the ratio of pile-to-ground warp is a critical parameter in the manufacture of terry cloth.

Terry cloth has heretofore been produced on mechanically controlled looms manufactured by C&K Corp., Worcester, Mass.; Draper Corp., Greensboro, N.C.; and Sulzer Brothers, Ltd., Winterthur, Switzerland and others. These looms employ a "positive" pile let-off, in which a mechanical rachet device dispenses a predetermined amount of terry yarn based upon a mechanical gear ratio. Mechanically controlled looms are capable of producing terry having a consistently uniform pile-to-ground warp ratio because the correct amount of pile warp is supplied for each pick of the loom. However, such mechanically controlled terry looms typically operate at very slow rate, and require major mechanical changes to set up for a different ratio of pile-to-ground warp.

More recently, electronically controlled high speed looms, such as the Sulzer Brothers models PU and TW 11 looms, have been introduced, in an effort to make terry looms mechanically simpler and to reduce changeover time. These electronically controlled looms are described in U.S. Pat. Nos. 3,871,419 to Pfarrwaller; 4,122,873 to Pfarrwaller et al; and 4,569,373 to Vogel.

In an electronically controlled Sulzer terry loom, ground and pile warps move past a reciprocally operable reed and a displacable rocking bar. The ground warp continuously is dispensed from its supply-beam, while the pile warp is dispensed from its supply beam under the control of a "negative" pile warp let-off motor. The negative pile let-off motor controls let-off as a function of pile warp tension, with the amount of terry yarn dispensed being that amount required to maintain constant tension on the pile warp. In a typical three-pick weaving cycle, the rocking bar is maintained in a first position as the filling yarn is carried to the fell twice in succession. Before the reed is displaced a third time, the pile warp let-off motor dispenses pile yarn and the rocking bar is displaced to move the fell of the cloth towards the reed. As a result, when the reed carries the filling yarn to the fell of the cloth, loops of the pile yarn are formed in a row across the top and bottom of the base fabric. The rocking bar is then withdrawn to its initial position to permit the three-pick weaving cycle to be repeated.

Terry looms with electronically controlled motorized negative type let-off attempt to control the pile-to-ground warp yarn ratio by monitoring the tension of the pile yarn at a location near its supply beam. For example, in one version of the Sulzer machine, the ends of the pile yarn pass over a flexible beam as they are fed into the loom. A metallic flag is secured to the beam so as to move toward or away from the pile yarn supply beam as the beam flexes in response to the amount of tension applied to the pile warp. A proximity sensor is mounted adjacent the flag. This sensor produces an output voltage having a magnitude which is dependent upon the distance between it and the flag. As tension on the pile warp changes, the flag's movement alters the sensor's output voltage. This output voltage is supplied to circuitry which produces signals for increasing or decreasing the speed of the pile warp let-off motor to alter the amount of pile yarn dispensed from its supply beam and thereby maintain constant tension on the yarn. Thus, as pile warp tension increases, the pile warp let-off motor accelerates to decrease the tension, and as pile warp tension decreases, the pile warp let-off motor decelerates to increase tension.

It has been found that tension control of a negative type pile let-off produces an unacceptable variation in terry height, with a consequent unacceptable reject rate of the terry cloth. Accordingly, efforts have been made to modify the Sulzer machine control mechanism to obtain a uniform ratio of pile-to-ground warp. One such attempt is described in Dorman et al U.S. Pat. No. 4,721,134. This patent describes control of terry loop height by controlling not only the pile warp tension but also the distance the rocking bar moves during the weaving operation. Means are provided for automatically adjusting the rocking bar distances and the pile warp tension during weaving in an attempt to maintain the constant pile-to-ground warp ratio. In particular, a controller is responsive to the tension on the pile warp yarn, to the rate at which the pile warp yarn is dispensed and to a preprogrammed desired pile-to-ground warp ratio to produce a control signal for the pile let-off motor. A threshold signal is also produced when the actual pile-to-warp ratio exceeds the desired pile-to-ground warp ratio by a threshold level. The rocking bar distance is altered during weaving in response to this signal.

Unfortunately, the control technique described in the Dorman et al. patent requires a complex control system to control pile warp tension, pile let-off and rocking bar distance. Even more importantly, it has been reported that this complex control system does not always provide a consistently uniform pile-to-ground warp ratio, resulting in unacceptable terry cloth. Accordingly, the art has heretofore not provided a simple method and apparatus for effectively controlling an electronic terry loom having a negative pile let-off.

SUMMARY OF THE INVENTION

It is therefore an object of the present invention to provide a method and apparatus for electronic control of terry looms.

It is another object of the present invention to provide a method and apparatus for electronically controlling terry looms having negative pile let-off to produce a uniform ratio of pile-to-ground warp.

It is still another object of the present invention to provide simplified electronic control of a terry loom having negative pile let-off, which can be easily implemented in existing and future looms.

These and other objects are provided, according to the present invention, by electronically controlling a negative pile warp let-off motor in a terry loom, to dispense pile warp yarn at a rate which yields the desired pile-to-ground warp ratio and is independent of the tension on the pile warp yarn. The desired rate of pile warp letoff may be provided to the loom controller as a known quantity, or may be calculated by the loom controller based upon a known desired pile-to-ground warp ratio and the ground warp let-off rate. The ground warp let off rate may be provided to the loom controller as a known quantity or may be measured based on the loom ground-warp speed or the loom pick rate. The desired pile warp let-off rate is compared to the actual pile warp let-off rate, and a signal is generated, based upon deviations between actual and desired pile warp let-off rates, to control the pile warp let-off motor. The actual pile warp let-off rate may be sensed, using a tachometer, optical encoder or other known sensing means.

According to the present invention, control of pile warp tension is not employed at all to control the pile let-off rate. In fact, when modifying an existing electronically controlled Sulzer loom to incorporate the improved control of the present invention, the tension control is disabled during terry formation. Moreover, no attempt is made to electronically control the rocking arms during weaving, nor is such control necessary according to the present invention. The controller is only responsive to the rate of pile warp let-off. A simplified controller may therefor be employed.

The present invention provides a uniform pile-to-ground warp ratio because the amount of pile let-off is directly controlled by the machine regardless of the tension on the pile. The terry reject rate is thereby minimized. Existing electronically controlled looms having negative pile let-off may be easily modified according to the present invention, by disabling the tension control, adding a tachometer or optical encoder for the pile warp beam, and either reprogramming the existing controller or substituting a new controller which controls the negative pile let-off. Simplified and accurate control is thereby provided.

DETAILED DESCRIPTION OF THE PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, applicants provide their embodiment so that this disclosure will be thorough and complete, and will fully convey the scope of the invention to those skilled in the art. Like numbers refer to like components throughout.

Figure 1:
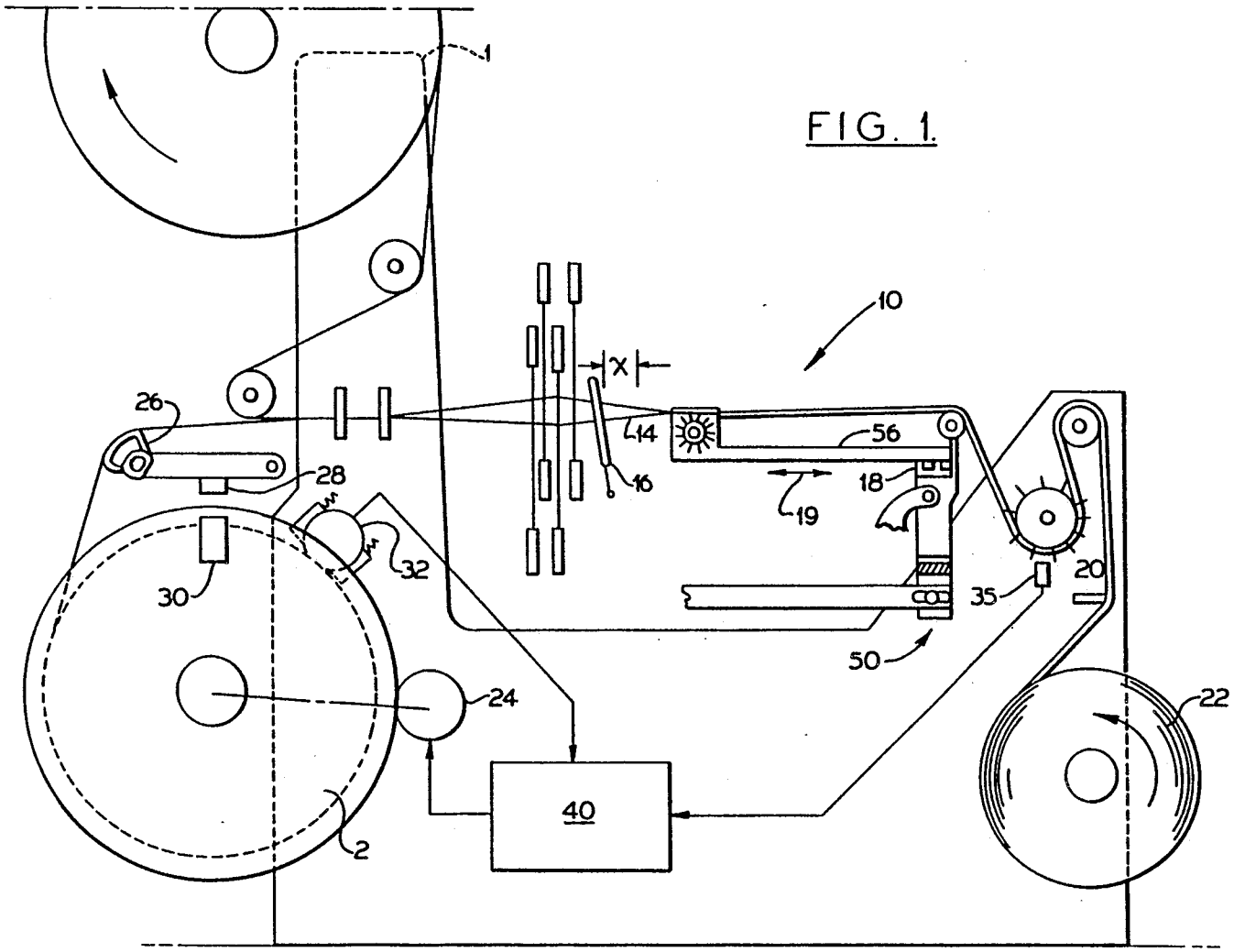
FIG. 1 is a simplified side elevational view of a terry loom according to the present invention.

Referring now to FIG. 1, a simplified side elevational view of a terry loom according to the present invention is shown. As illustrated in FIG. 1, loom 10 is a commercially available electronically controlled, negative let-off Sulzer loom such as Models PU or TW 11, which has been modified according to the present invention. It will be understood by those having skill in the art that other commercially available looms may be modified for control according to the present invention, and looms may be originally designed and manufactured for control according to the present invention.

Loom 10 includes a ground warp supply beam 1 and a pile warp supply beam 2. Yarn from each of beams 1 and 2 is directed around the beams and past harnesses to the area 14 where weft or filling yarn (not shown) is woven through the warp yarns in the customary fashion. Area 14 lies between an oscillating reed 16 and a rocking bar 56, which is reciprocally movable along a path extending in the direction of warp yarn travel as shown by arrow 19. As it moves toward the bar 56, the reed 16 positively carries the filling yarn to the fell of the cloth being woven. The cloth thereafter moves past the needle type takeup beam 20 which rotates at a constant speed, and then is collected by a final beam 22.

The ground warp yarn is removed continuously from beam 1, with the rate of removal being controlled by the takeup beam 20. Thus, the amount of warp yarn dispensed from beam 1 is continuous and is a known quantity that remains constant throughout the weaving operation. The pile warp yarn is dispensed from beam 2 in a negative let-off, in response to signals to the pile warp let-off motor 24.

In the aforementioned Sulzer machines, as the pile warp leaves beam 2, it passes over a tensioning beam 26. Beam 26 is of the type disclosed, for example, in Pfarrwaller U.S. Pat. No. 3,817,419 and is pivotally mounted for deflection. In the Sulzer loom, a flag 28 is attached to beam 26, with the other end of the flag being positioned to fixed proximity sensor 30. When the tension in the pile warp varies, beam 26 deflects thus altering the distance between the flag 28 and sensor 30. The sensor thereby produces an electrical output signal which is a function of pile warp tension.

According to the present invention, the tension in the pile warp yarn is NOT controlled to produce uniform terry height. Accordingly, the proximity sensor 30 is disabled and beam 26 is maintained at a fixed position. As will be described below, according to the present invention the amount of pile warp dispensed, and not the tension in the pile warp, is directly controlled.

Also illustrated in FIG. 1 is an electronic control arrangement, represented by 50, which is employed according to Dorman et al U.S. Pat. No. 4,721,134 to electronically adjust the rocking bar distance X during weaving. According to the present invention, electronic control of the rocking bar distance X is NOT employed to control pile-to-ground warp ratio, and any electronic control for rocking bar 56, if present, is disabled. Rocking bar 56 may be mechanically adjusted when the loom is not weaving, but is not electronically controlled on the fly according to the present invention. Accordingly, compared to the Sulzer loom disclosed in Pfarrwaller et al U.S. Pat. No. 4,122,873 and the modified loom of Dorman et al U.S. Pat. No. 4,721,134, greatly simplified control is provided by the present invention.

According to the invention, an encoder 32 is operably related to the pile warp yarn as it is discharged from beam 2. Encoder 32 is a conventional device commonly employed in industrial applications to produce an electrical output as a function of rotation imparted to a roller portion thereof. One encoder suited for this purpose is a model REX-32 encoder manufactured by Sunx of Japan. Another encoder suitable for this purpose is the Accu-Coder model 716-S manufactured by Encoder Products Company of Standpoint, Id. This type of encoder produces a given number of electrical output pulses for each revolution of its roller. As employed in the present invention, the encoder roller is spring biased against the pile warp yarn on beam 2, thereby producing, as the beam rotates, an electrical signal which accurately indicates the rate the yarn is discharged from the beam. This rate is, of course, directly proportional to the amount of yarn dispensed from the beam. The signal from encoder 32 is provided to controller 40 and is utilized as described in connection with FIGS. 2 and 3.

Prior to describing a detailed embodiment of controller 40, the control technique of the present invention will be generally described. According to the invention, the output signal from encoder 32 is applied to controller 40 which in a preferred embodiment is a microprocessor controller. The controller also obtains data regarding the desired pile warp rate. This data may be preset in controller 40 using a keyboard or other well known means. Alternatively, the data regarding the desired pile warp rate may be calculated by multiplying the ground warp rate by the desired pile-to-ground warp ratio. The data representing the desired pile-to-ground warp ratio may be preset in controller 40. The data representing the ground warp rate may be obtained by monitoring a signal related to the pick rate, which may be provided as part of the original machine circuits, and which in turn is directly related to the ground warp rate. Alternately, the speed of the constant speed shaft takeup beam 20 may be monitored via an encoder 35, which may be provided as part of the original machine circuits. As another alternative, the ground warp rate for which the machine is set may be preset in the controller 40 using a keyboard or other well known input means, and treated as a constant quantity.

According to the invention, the desired pile warp let-off rate may be continuously compared with the actual pile warp rate obtained from encoder 32. If the actual pile let-off rate departs from the desired pile let-off rate, a signal determined by the difference between the actual and desired rates is produced by controller 40 to adjust the actual rate at which pile warp yarn is discharged from beam 2 by adjusting the motor drive 24.

Figure 2:
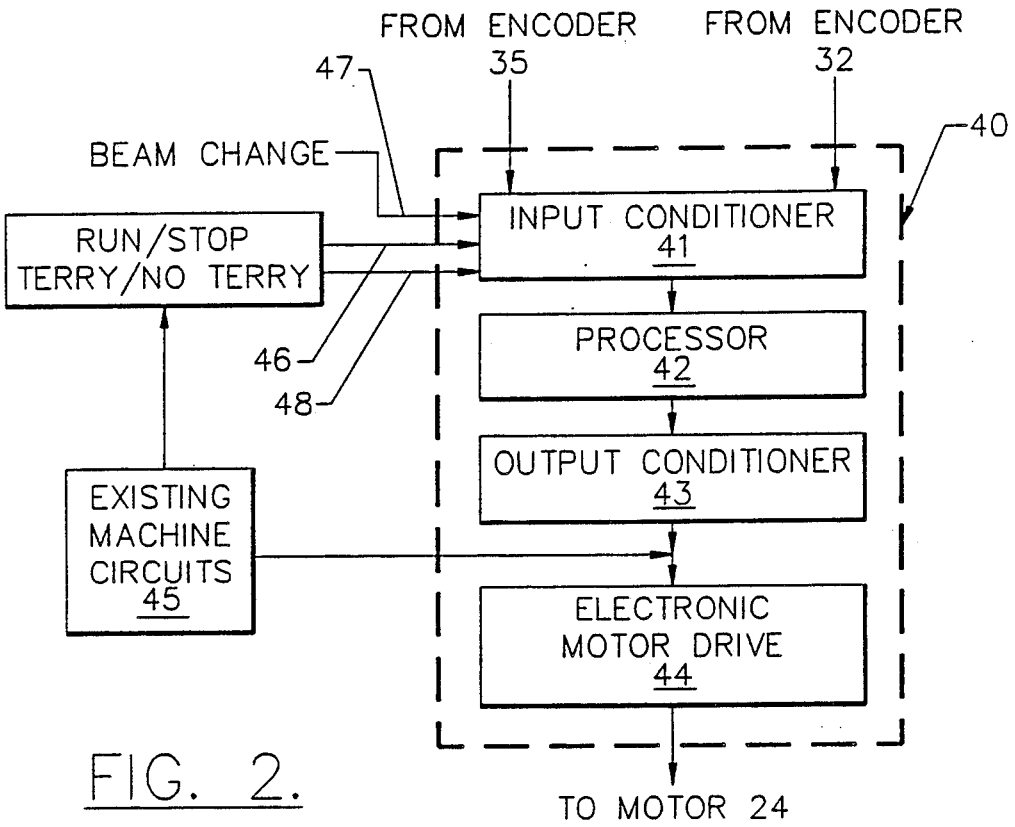
FIG. 2 is a simplified block diagram of an electronic controller for controlling the loom of FIG. 1 according to the present invention.

Referring now to FIG. 2, a detailed embodiment of controller 40 will be described. As shown in FIG. 2, controller 40 may include an input conditioner 41, a processor 42, an output conditioner 43, and an electronic motor drive 44.

Input conditioner 41 which may be a model 1771IB high speed input card manufactured by Allen Bradley, Inc., Cleveland, Ohio, provides conditioning of input signals. In the embodiment shown, the pile warp let-off rate signal from encoder 32 and the ground warp let-off rate signal from encoder 35 are provided as inputs to input conditioner 41, although, as described above, the ground warp let-off rate may be treated as a constant and not monitored separately. Also provided to input conditioner 41 is a run/stop signal 46, a beam change signal 47, and a terry/no terry signal 48. Run/stop signal 46 causes controller 40 to stop operating when the loom is stopped. Beam change signal 47 causes the controller to recompute the desired beam speed when a new pile beam 2 is placed on the loom, as described below. Terry/no terry signal 48 may be provided to allow control of loom operation by existing machine circuits 45 when terry is not being manufactured by the loom (for example during the header portion of the terry cloth) and to allow control by controller 40 when terry is being manufactured. Alternatively, controller 40 may control both the terry and non- terry portions, or the existing machine circuits may be modified according to the present invention to control both terry and non-terry operations.

Input conditioner 41 is electrically connected to processor 42, which may be an Allen Bradley model PLC 5/15 microprocessor controller. Associated with processor 42 is a memory in which a computer program may be stored for controlling operation of the processor 42. The operation of this program to control processor 42 will be described below in connection with FIGS. 3A and 3B. Processor 42 is connected to an output conditioner 43 which conditions the processor signal for controlling the pile warp let-off rate to provide the proper voltage levels for the electronic motor drive 44. Output conditioner 43 may be an Allen Bradley model 17710FE Analog Output Module. The signal from output conditioner 43 is provided to an electronic motor drive 44 which may be the electronic motor drive which is contained in the existing machine controller. Alternatively, a new electronic motor drive may be provided for motor 24. The electronic motor drive may also be employed by existing machine circuits 45 to drive motor 24 during non-terry production.

Figure 3A:
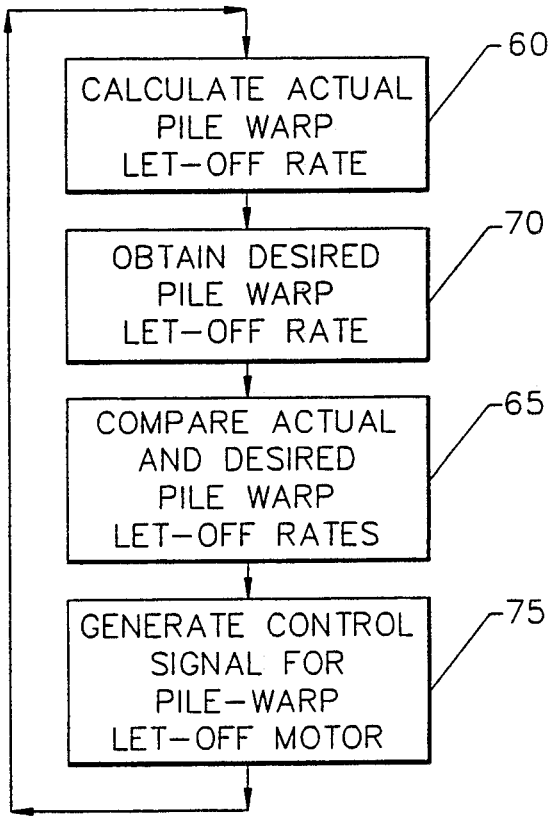
FIGS. 3A and 3B are flow diagrams illustrating certain operations which may be employed to control the loom of FIG. 1 according to the present invention.

Referring now to FIG. 3A, a simplified flow diagram illustrating the operation of a control program for processor 42 will now be described. The actual pile warp let-off rate is first calculated at block 60. This calculation is performed by processing the signal provided by the encoder 32. Each signal provided by the encoder 32 may be employed to calculate the actual pile warp let-off rate. Alternatively, as described in connection with FIG. 3B, sampling and averaging may be employed to reduce short term variations in measured pile warp let-off rate.

At block 65, the actual and desired pile warp let-off rates are compared. Before comparing, the desired pile warp let-off rate must be obtained (block 70). As described above, the desired pile warp let-off rate may be obtained by measuring the actual ground warp rate and multiplying by a preset pile-to-ground warp ratio. Alternatively, the desired pile warp let-off rate may be provided as a constant to the controller. After comparing the actual and desired pile warp let-off rates (block 65) a control signal for the pile warp let-off motor 24 (FIG. 1) is generated (block 75) based upon the difference between the actual and desired pile warp let-off rates. This signal is applied to motor 24 to thereby control the let-off rate. It will be understood by those having skill in the art that the control signal may be generated using well-known proportional, integral and derivative (P-I-D) control or other control signal generating methods. The process described in FIG. 3A is continuously repeated so that continuous control of pile warp let-off motor 24 is obtained.

Figure 3B:
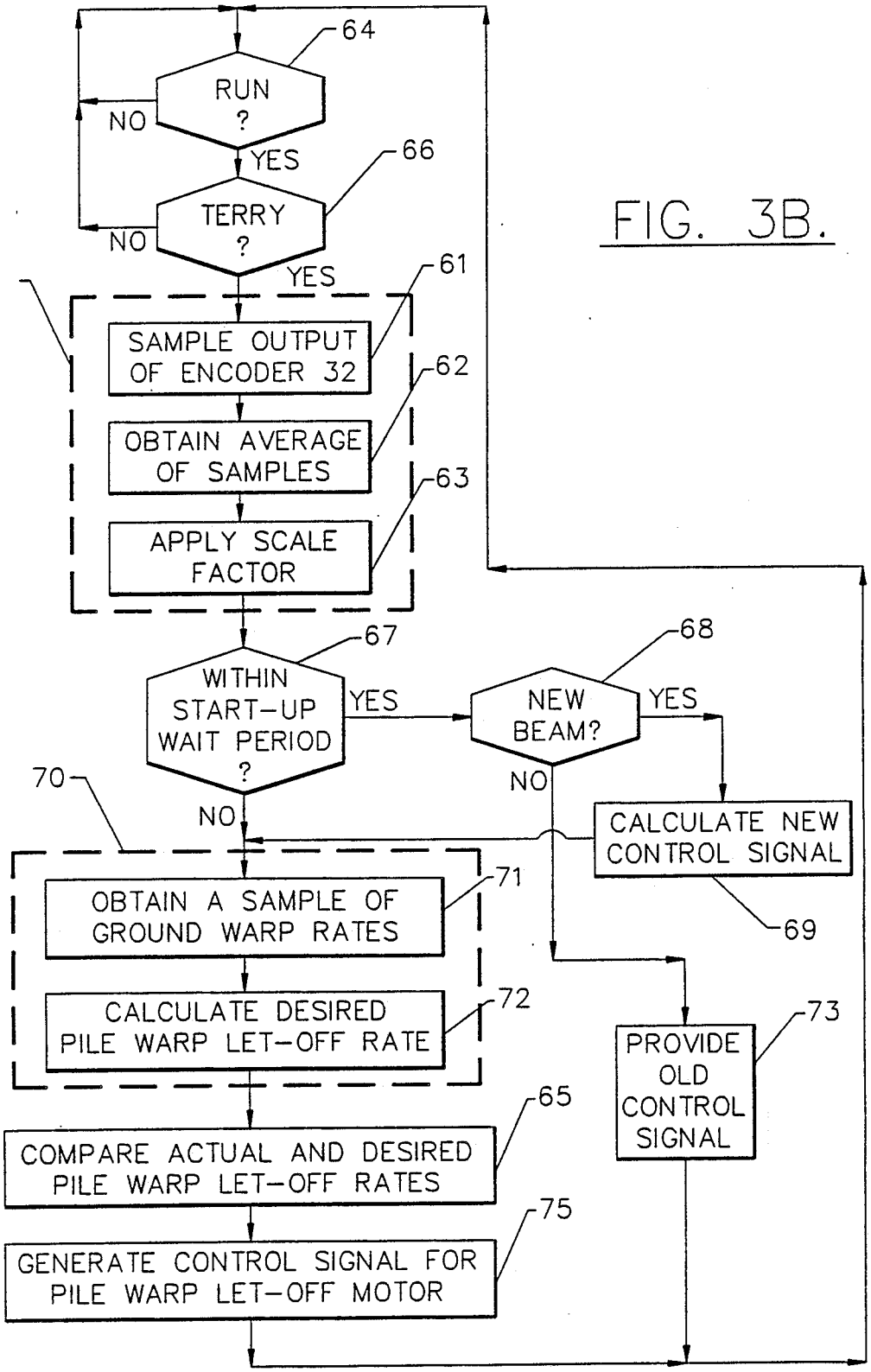

Referring now to FIG. 3B, a detailed flow diagram illustrating the operation of a control program for processor 42 will now be described. The detailed flow diagram of FIG. 3B provides more complex actual pile warp let-off rate measurement and also includes steps for preventing erroneous control during loom startup or beam changeover. Referring to FIG. 3B, the control program first determines if the machine is in its run mode (block 64). If yes, then it is determined whether terry is being produced (block 66). If not, the controller waits until the terry signal 48 (FIG. 2) is present. Once the terry signal is present, the actual pile warp let-off rate is calculated (block 60) using a sample and average technique. The output of encoder 32 is sampled (block 61) and a running average of the samples is obtained (block 62). In one embodiment, the encoder output may be sampled every half second, the ten last samples may be accumulated, and a running average of the last ten samples may be obtained. A scale factor may be applied (block 63) to thereby calculate the actual pile warp consumption rate by converting a pulses per second measurement to an inches per minute measurement.

Still referring to FIG. 3B, a check is made at block 67 whether the loom is within its startup period, during which erroneous data may have been captured. If it is within the startup period, which may be set at ten seconds, a check is made as to whether a new beam has been mounted by checking beam change signal 47 (FIG. 2). If a new beam was not mounted, meaning that the machine was stopped and restarted without changing beams, then for the initial few seconds of the run the old control signal is provided to motor 24 (block 73). A new control signal is not computed until the machine has settled down. On the other hand, if a new beam has been mounted, a new control signal is calculated (block 69) by performing the steps described in FIG. 3B.

Still referring to FIG. 3B, after the startup period has elapsed, or during the startup period for a new beam, the actual and desired pile warp let-off rates are compared at block 65. As was described above, the desired pile warp let-off rate may be applied as a constant or may be applied by providing an encoder 35 to obtain the machine run rate. If an encoder 35 is provided, then the actual ground warp rate is sampled at block 71. Because the actual ground warp rate is relatively constant, this rate may be sampled once every fifteen seconds or longer, and an averaging technique need not be employed. Then, the desired, pile warp let-off rate 72 may be automatically, for example, by controller 40, calculated by multiplying the ground warp rate by the desired pile-to-ground warp ratio. It will be understood by those having skill in the art that if the pick rate is to be employed, the pick rate is sampled and converted to a pile warp let-off rate and multiplied by the pile-to-ground warp ratio to provide the desired warp let-off rate signal. Then, at block 75, a control signal for the pile warp let-off motor 24 is generated using well-known control system techniques.

Based upon the above description, it will be understood by those having skill in the art that the present invention does not monitor tension on the pile warp nor does it attempt to control rocking bar displacement. Simplified control of pile warp let-off rate is provided, to obtain accurate control of pile warp let-off, resulting in high quality terry.

In the drawings and specification, there have been disclosed typical preferred embodiments of the invention and, although specific terms are employed, they are used in a generic and descriptive sense only and not for purposes of limitation, the scope of the invention being set forth in the following claims.

That which we claim is:

1. A terry loom comprising:

a first supply beam from which pile warp yarn is dispensed;

a negative pile warp let-off motor connected to said first supply beam, for dispensing said pile warp yarn from said first supply beam at a variable rate and under variable tension;

a second supply beam from which ground warp yarn is continuously dispensed;

a reciprocally operable read past which said pile and ground warp yarns are directed to weave terry;

means for sensing the variable rate at which the pile warp yarn is dispensed from the first supply beam, and for producing a first electrical signal responsive thereto; and electronic control means responsive to said first electrical signal, and to data representing a desired pile warp yarn dispensing rate, for producing an output signal determined by the difference between said first electrical signal and the desired pile warp yarn dispensing rate, independent of the variable tension on said pile warp yarn, and for applying said output signal to said pile warp let-off motor to control said variable rate at which the pile warp yarn is dispensed;

whereby pile warp yarn is dispensed by said negative let-off motor to produce the desired pile-to-ground warp ratio.

2. The terry loom of claim 1 wherein said electronic control means further comprises means for representing the desired pile warp dispensing rate as a preset quantity in said electronic control means.

3. The terry loom of claim 1 wherein said electronic control means further comprises means for calculating the data representing the desired pile warp dispensing rate from data representing a desired pile-to-ground warp ratio and data representing the rate at which the ground warp yarn is continuously dispensed.

4. The terry loom of claim 1 wherein said sensing means comprises an encoder coupled to said pile yarn, and wherein said first electrical signal comprises a series of electrical pulses related to the variable rate at which the pile warp yarn is dispensed.

5. The terry loom of claim 3 further comprising means for sensing the rate at which the ground warp yarn is continuously dispensed, and which is connected to said electronic control means to provide said data representing said predetermined rate at which ground warp yarn is continuously dispensed.

6. The terry loom of claim 5 wherein said means for sensing the rate at which the ground warp yarn is continuously dispensed comprises means for sensing the rate of operation of said reciprocally operable reed.

7. The terry loom of claim 5 wherein said electronic control means further comprises means for periodically sampling said means for sensing the rate at which the ground warp yarn is continuously dispensed, to thereby periodically update said data representing the rate at which the ground warp yarn is continuously dispensed.

8. The terry loom of claim 3 wherein said electronic control means further comprises means for representing a desired pile-to-ground warp ratio as a preset quantity in said electronic control means.

9. The terry loom of claim 3 wherein said electronic control means comprises:

means for multiplying said data representing the rate at which the ground warp yarn is continuously dispensed and said data representing a desired pile-to-ground warp ratio to obtain said desired pile warp yarn dispensing rate;

means for comparing said first electrical signal and said desired pile warp yarn dispensing rate to generate a difference signal; and means for generating said output signal from said difference signal, said output signal being generated to cause said negative pile warp let-off motor to dispense said pile warp yarn at the desired pile warp yarn dispensing rate.

10. The terry loom of claim 1 wherein said electronic control means comprises a stored program microprocessor.

11. The terry loom of claim 1 wherein said electronic control means further comprises means for obtaining a running average of said first electrical signal, said electronic control means being responsive to the running average of said first electrical signal and to data representing a desired pile warp yarn dispensing rate, for providing said output signal.

12. A terry loom comprising:

a first supply beam from which pile warp yarn is dispensed;

a negative pile warp let-off motor connected to said first supply beam, for dispensing said pile warp yarn from said first supply beam at a variable rate and under variable tension;

a second supply beam from which ground warp yarn is continuously dispensed;

a reciprocally operable reed past which said pile and ground warp yarns are directed to weave terry; and, means for electronically controlling said negative pile warp let-off motor to dispense said pile warp yarn at a desired rate which is independent of the tension on said pile warp yarn.

13. The terry loom of claim 12 wherein said electronically controlling means comprises means for electronically controlling said negative pile warp let-off motor to dispense said pile warp at a rate equal to a preset desired pile warp dispensing rate which provides a predetermined pile-to-ground warp ratio.

14. The terry loom of claim 12 wherein said electronically controlling means comprises means for controlling said negative pile warp let-off motor to dispense said pile warp at a rate which is equal to the product of a preset ground warp dispensing rate and a preset pile-to-ground warp ratio.

15. The terry loom of claim 12 further comprising means for sensing the rate at which the ground warp yarn is dispensed from the second supply beam; said electronically controlling means comprising means for electronically controlling said negative pile warp let-off motor to dispense said pile warp at a rate which is equal to the product of a preset pile-to-ground warp ratio and the rate sensed by said sensing means.

16. The terry loom of claim 12 further comprising means for sensing the rate at which pile warp yarn is dispensed from the first supply beam; said electronically controlling means comprising means for electronically controlling said negative pile warp let-off based upon the difference between the sensed rate at which pile warp yarn is dispensed and a desired pile warp yarn dispensing rate.

17. The terry loom of claim 12 wherein said electronic control means comprises a stored program microprocessor.

18. A method of controlling a terry loom having a first supply beam from which pile warp yarn is dispensed, a negative pile warp let-off motor for dispensing the pile warp yarn from the first supply beam at a variable rate and under variable tension, a second supply beam from which ground warp yarn is continuously dispensed, and a reciprocally operable reed past which the pile and ground warp yarns are directed to weave terry, said method comprising the steps of:

obtaining a desired pile warp yarn dispensing rate; and electronically controlling said negative pile warp let-off motor to dispense pile warp yarn at the desired pile warp yarn dispensing rate regardless of the tension on the pile warp yarn.

19. The method of claim 18 wherein said electronically controlling step comprises the steps of:

sensing the rate at which the pile warp yarn is dispensed from the first supply beam; and electronically controlling said negative pile warp let-off motor based upon the difference between the sensed rate and the desired pile warp dispensing rate.

20. The method of claim 19 wherein said sensing step comprises the steps of:

repeatedly sampling the rate at which the pile warp yarn is dispensed from the first supply beam; and averaging the repeated samples to thereby sense the rate at which the pile warp yarn is dispensed.

21. The method of claim 18 wherein said obtaining step comprises the steps of:

obtaining a ground warp yarn dispensing rate;

obtaining a desired pile-to-ground warp ratio; and multiplying said ground warp yarn dispensing rate and said pile-to-ground warp ratio.

22. The method of claim 21 wherein the step of obtaining a ground warp yarn dispensing rate comprises the step of obtaining a preset ground warp dispensing rate.

23. The method of claim 21 wherein the step of obtaining a ground warp yarn dispensing rate comprises the step of sensing the rate at which ground warp yarn is dispensed from the second supply beam.

24. The method of claim 21 wherein the step of obtaining a ground warp yarn dispensing rate comprises the step of sensing the rate at which said reciprocally operable reed reciprocates.

25. An electronic control system for a terry loom having a first supply beam from which pile warp yarn is dispensed, a negative pile warp let-off motor for dispensing the pile warp yarn from the first supply beam at a variable rate and under variable tension, a second supply beam from which ground warp yarn is continuously dispensed, and a reciprocally operable reed past which the pile and ground warp yarns are directed to weave terry, said electronic control system comprising:

means for sensing the variable rate at which the pile warp yarn is dispensed from the first supply beam, and for producing a first electrical signal responsive thereto; and electronic control means responsive to said first electrical signal, and to data representing a desired pile warp yarn dispensing rate, for producing an output signal determined by the difference between said first electrical signal and the desired pile warp yarn dispensing rate, said output signal being independent of the variable tension on said pile warp yarn, and for applying said output signal to said pile warp let-off motor to control said variable rate at which the pile warp yarn is dispensed;

whereby pile warp yarn is dispensed by said negative let-off motor to produce a desired pile-to-ground warp ratio.

26. The electronic control system of claim 25 wherein said electronic control means further comprises means for representing the desired pile warp dispensing rate as a preset quantity in said electronic control means.

27. The electronic control system of claim 25 wherein said electronic control means further comprises means for calculating the data representing the desired pile warp dispensing rate from data representing a desired pile-to-ground warp ratio and data representing the rate at which the ground warp yarn is continuously dispensed.

28. The electronic control system of claim 25 wherein said sensing means comprises an encoder coupled to said pile yarn, and wherein said first electrical signal comprises a series of electrical pulses related to the variable rate at which the pile warp yarn is dispensed.

29. The electronic control system of claim 27 further comprising means for sensing the rate at which the ground warp yarn is continuously dispensed, and which is connected to said electronic control means to provide said data representing said predetermined rate at which ground warp yarn is continuously dispensed.

30. The electronic control system of claim 29 wherein said means for sensing the rate at which the ground warp yarn is continuously dispensed comprises means for sensing the rate of operation of said reciprocally operable reed.

31. The electronic control system of claim 29 wherein said electronic control means further comprises means for periodically sampling said means for sensing the rate at which the ground warp yarn is continuously dispensed, to thereby periodically update said data representing the rate at which the ground warp yarn is continuously dispensed.

32. The electronic control system of claim 27 wherein said electronic control means further comprises means for representing a desired pile-to-ground warp ratio as a preset quantity in said electronic control means.

33. The electronic control system of claim 27 wherein said electronic control means comprises:

means for multiplying said data representing the rate at which the ground warp yarn is continuously dispensed and said data representing a desired pile-to-ground warp ratio to obtain said desired pile warp yarn dispensing rate;

means for comparing said first electrical signal and said desired pile warp yarn dispensing rate to generate a difference signal; and means for generating said output signal from said difference signal, said output signal being generated to cause said negative pile warp let-off motor to dispense said pile warp yarn at the desired pile warp yarn dispensing rate.

34. The electronic control system of claim 25 wherein said electronic control means comprises a stored program microprocessor.

35. The electronic control system of claim 25 wherein said electronic control means further comprises means for obtaining a running average of said first electrical signal, said electronic control means being responsive to the running average of said first electrical signal.

36. An electronic control system for a terry loom having a supply beam from which pile warp yarn is dispensed, a negative pile warp let-off motor for dispensing the pile warp yarn from said first supply beam at a variable rate and under variable tension, a second supply beam from which ground warp yarn is continuously dispensed, and a reciprocally operable reed past which said pile and ground warp yarns are directed to weave terry, said electronic control system comprising:

means for electronically controlling said negative pile warp let-off motor to dispense said pile warp yarn at a desired rate which is independent of the tension on said pile warp yarn.

37. The electronic control system of claim 36 wherein said electronically controlling means comprises means for controlling said negative pile warp let-off motor to dispense said pile warp at a rate which is equal to a preset desired pile warp dispensing rate, said preset desired pile warp dispensing rate being calculated to obtain a predetermined pile-to-ground warp rate ratio.

38. The electronic control system of claim 36 wherein said electronically controlling means comprises means for controlling said negative pile warp let-off motor to dispense said pile warp at a rate which is equal to the product of a preset ground warp dispensing rate and a preset pile-to-ground warp ratio.

39. The electronic control system of claim 36 further comprising means for sensing the rate at which the ground warp yarn is dispensed from the second supply beam; said electronically controlling means comprising means for electronically controlling said negative pile warp let-off motor to dispense said pile warp at a rate which is equal to the product of a preset pile-to-ground warp ratio and the rate sensed by said sensing means.

40. The electronic control system of claim 36 further comprising means for sensing the rate at which pile warp yarn is dispensed from the first supply beam; said electronically controlling means comprising means for electronically controlling said negative pile warp let-off based upon the difference between the sensed rate at which pile warp yarn is dispensed and a desired pile warp yarn dispensing rate.

41. The electronic control system of claim 36 wherein said electronic control means comprises a stored program microprocessor.

* * * * *

UNITED STATES PATENT AND TRADEMARK OFFICE

CERTIFICATE OF CORRECTION

PATENT NO. : 5,002,095

DATED : March 26, 1991

INVENTOR(S) : Herrin et al.

It is certified that error appears in the above-identified patent and that said Letters Patent is hereby corrected as shown below:

Column 4, line 1, please delete "TW 11" and substitute --TW 11-- therefor.

Column 7, line 39, after "desired" please delete ",".

Column 7, line 40, after "automatically" please insert --calculated--.

Column 7, lines 40 and 41, please delete the word "calculated".

Column 8, line 5, please delete "read" and substitute --reed-- therefor.

Signed and Sealed this

Eighth Day of September, 1992

*Attest:*

DOUGLAS B. COMER

*Attesting Officer*

*Acting Commissioner of Patents and Trademarks*